US005769013A

United States Patent [19]

Morita

[11] Patent Number: 5,769,013

[45] Date of Patent: Jun. 23, 1998

[54] SEWING DATA PROCESSING DEVICE WITH DISPLAY STATE CHANGING FUNCTION

[75] Inventor: Nami Morita, Nagoya, Japan

[73] Assignee: Brother Kogyo Kabushiki Kaisha, Nagoya, Japan

[21] Appl. No.: 769,417

[22] Filed: Dec. 19, 1996

[30] Foreign Application Priority Data

Dec. 20, 1995 [JP] Japan ..... 7-332365

[51] Int. Cl.[6] ..... D05C 5/02

[52] U.S. Cl. ..... 112/102.5; 112/445; 112/458

[58] Field of Search ..... 112/470.01, 445, 112/456, 458, 102.5, 470.06; 364/470.08, 470.09, 470.07

[56] References Cited

U.S. PATENT DOCUMENTS 4,660,488 4/1987 Hanyu et al. ..... 112/458 X
4,688,503 8/1987 Kato ..... 112/458 X
5,042,410 8/1991 Nakashima ..... 112/445
5,390,126 2/1995 Kongho et al. ..... 112/458 X
5,427,044 6/1995 Hirabayashi ..... 112/458 X

FOREIGN PATENT DOCUMENTS

A-8-112469 5/1996 Japan .

*Primary Examiner*—Peter Nerbun
*Attorney, Agent, or Firm*—Oliff & Berridge, PLC

[57] ABSTRACT

A realistic image of a sewing pattern is displayed based on sewing pattern data indicative of a shape of the sewing pattern. The state of the sewing pattern can be changed. When desiring to change the sewing pattern state while the image of the sewing pattern is displayed in the image display mode, the display state is changed from the image display mode into a rectangular-frame display mode so that a rectangular frame representative of the sewing pattern is displayed. When the pattern state change is completed, the image of the changed sewing pattern is displayed.

16 Claims, 13 Drawing Sheets

SUBROUTINE
S30
IMAGE SCREEN ?
NO
YES
RECTANGULAR SCREEN
S32
S33
IMAGE KEY ?
YES
NO
S34
ENLARGE KEY ?
YES
NO
S36
NO
REDUCE KEY ?
YES
MULTIPLY THE OUTER DIMENSIONS BY REDUCTION RATE
S40
MULTIPLY OUTER DIMENSIONS BY MAGNIFICATION RATE
S38
CALCULATE RECTANGLE DATA
S42
CHANGE RECTANGLE SCREEN
S44
S46
NO
COMPLETION KEY ?
YES
PRODUCE IMAGE DATA
S48
IMAGE DATA SCREEN
S50
RETURN

SEWING DATA PROCESSING DEVICE WITH DISPLAY STATE CHANGING FUNCTION

BACKGROUND OF THE INVENTION

1. Field of the Invention

The present invention relates to a sewing data processing device for processing sewing data for sewing embroidery patterns with using home sewing machines and industrial sewing machines.

2. Description of the Related Art

Conventionally, a sewing data processing device has been proposed for an industrial sewing machine. The sewing data processing device includes a microcomputer and is capable of producing sewing pattern data with high accuracy. For example, the sewing data processing device is constructed from a personal computer system connected with an image scanner, a key board, a mouse, a hard disk driver, a CRT display, and the like. Based on original images of any desired embroidery patterns, the sewing data processing device can produce sewing pattern data indicative of sewing patterns in multi colors.

To meet the increasingly varied tastes of consumers and their desire for higher quality products, a home embroidery sewing machine is also desired to be provided with a sewing data processing device. The sewing data processing device can edit embroidery patterns, stored previously in the sewing machines, into those desired by an operator. For example, the sewing data processing device can enlarge and reduce the size of the embroidery patterns, rotate the embroidery patterns, change the intervals between the embroidery patterns, and modify an arrangement how the embroidery patterns are arranged. The sewing data processing device is relatively cheap and is easy to manipulate. With the sewing data processing device, therefore, the home embroidery sewing machine can sew not only the embroidery patterns previously stored in the sewing machine but also an operator's desired embroidery patterns.

SUMMARY OF THE INVENTION

The conventional sewing data processing device enlarges and reduces the sizes of the embroidery patterns while displaying the embroidery patterns in an image display mode. It is therefore necessary to produce image data of the embroidery patterns while enlarging or reducing the sizes of the embroidery patterns. It requires a long period of time to produce the image data. It is impossible to display the image of the embroidery pattern within a short period of time after the operator manipulates the device to designate his/her desire enlargement or reduction. This leads to a serious problem when the operator controls the device to change the sizes of the embroidery patterns many times, when the embroidery patterns have complicated structures, and when the embroidery patterns are large in size.

It is therefore, an object of the present invention to overcome the above-described drawbacks, and to provide an improved sewing data processing device which can change a display state of the embroidery patterns.

In order to attain these and other objects, the present invention provides a sewing data processing device for processing sewing data, comprising: display means for displaying a sewing pattern based on sewing pattern data indicative of a shape of the sewing pattern, the display means being capable of displaying the sewing pattern both in a first display mode and in a second display mode; pattern state changing means for changing a pattern state of the sewing pattern; and display changing means for changing the display state of the sewing pattern from the first display mode into the second display mode before the pattern state changing means changes the pattern state of the sewing pattern. The display means may be capable of displaying the sewing pattern both in an image display mode and in another display mode, and the display changing means may change the display state of the sewing pattern from the image display state into the other display state before the pattern state changing means changes the pattern state of the sewing pattern. The sewing data processing device may further comprise additional display changing means for changing the display mode form the other display state back to the image display mode after the pattern state changing means has changed the pattern state. The other display state may display a predetermined shape which corresponds to a size of the sewing pattern. The pattern state changing means may change the size of the sewing pattern. The pattern state changing means may rotate the sewing pattern. The predetermined shape of the sewing pattern may be made from a line indicative of an outward form of the sewing pattern.

According to another aspect, the present invention provides a sewing data processing device for processing sewing data, comprising: display means for displaying a sewing pattern based on sewing pattern data indicative of a shape of the sewing pattern, the display means being capable of displaying a realistic image of the sewing pattern and a representative image of the sewing pattern; pattern state changing means for changing a pattern state of the sewing pattern; and display control means for controlling the display means to display the representative image of the sewing pattern while the pattern state changing means changes the pattern state of the sewing pattern. The display control means may control the display means to display the realistic image of the sewing pattern after the pattern state changing means has changed the pattern state. The representative image of the sewing pattern may have a predetermined shape corresponding to a size of the sewing pattern. The predetermined shape may be made from a line indicative of an outward form of the sewing pattern. The predetermined shape may be made from a frame surrounding the sewing pattern.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
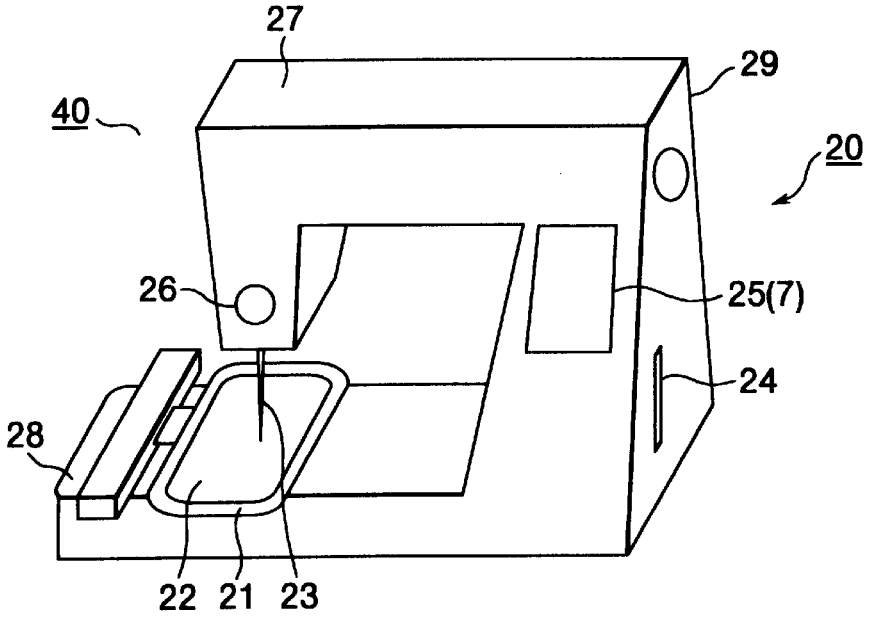
FIG. 1 is an external perspective view of a home embroidery sewing machine according to an embodiment of the present invention.

A sewing data processing device according to a preferred embodiment of the present invention will be described while referring to the accompanying drawings wherein like parts and components are designated by the same reference numerals.

This embodiment provides a home embroidery machine to which the sewing data processing device of the present invention is applied.

The overall structure of the home embroidery machine will be described with reference to FIG. 1.

The home embroidery machine 20 is for producing an operator's desired embroidery data and then sewing the operator's desired embroidery on a work fabric 22 based on the produced embroidery data.

Figure 2:
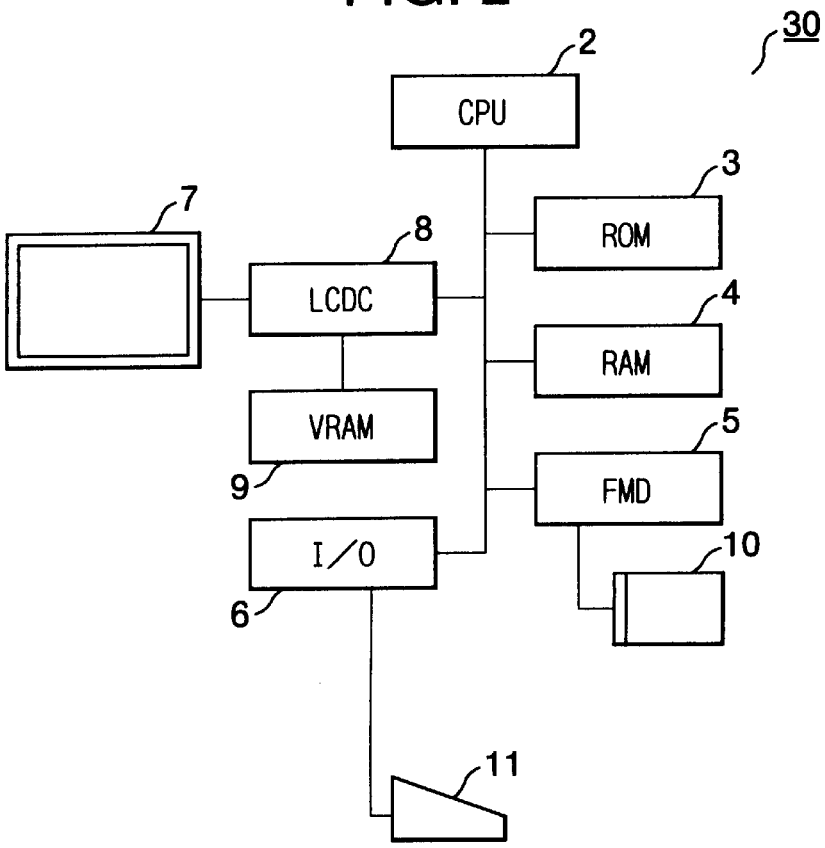
FIG. 2 is a block diagram showing an internal structure of a control portion (embroidery data producing circuit) employed in the sewing machine of FIG. 1.

The home embroidery machine 20 is comprised of a control portion 30 shown in FIG. 2 and a sewing portion 40 shown in FIG. 1. The sewing portion 40 is for sewing embroideries on a work fabric 22 based on embroidery data. The sewing portion 40 has a head portion 27, a bed portion 28, and a column portion 29.

The head portion 27 is provided with a stitching needle 23 which is controlled to move vertically relative to the bed portion 28. As shown in FIG. 1, a sewing start key 26 is mounted to the head portion 27.

The home embroidery machine 20 is operated with an embroidery frame 21 for supporting a work fabric 22 desired to be sewn with embroideries. The home embroidery machine 20 is provided with a horizontal movement mechanism (not shown) for moving the embroidery frame 21 horizontally along the bed portion 28. The horizontal movement mechanism moves the embroidery frame 21 to the operator's desired positions indicated by an X-Y coordinate system which is determined on the bed portion 28. With this structure, when the embroidery frame 21 moves the work fabric 22 in the horizontal direction, the stitching needle 23 moves vertically relative to the embroidery frame 21, thereby sewing the work fabric 22 with desired embroidery patterns.

It is noted that a sewable region 103 is defined as a region, within which the stitching needle 23 can sew embroideries on the work fabric 22. The sewable region 103 is defined on the X-Y coordinate system along the bed portion 28. The sewable region 103 is determined dependently on a range in which the horizontal moving mechanism can move the embroidery frame 21 along the bed portion 28.

The column portion 29 is provided with a touch panel 25 made from a liquid crystal display (LCD) 7. The touch panel 25 displays various screens shown in FIGS. 5–11 as will be described later. The column portion 29 is also formed with a flash memory insertion slot 24 for receiving a flash memory 10 therein.

The control portion 30 is for producing embroidery data indicative of the operator's desired embroidery, recording the embroidery data in the flash memory 10, and controlling the horizontal movement mechanism, based on the embroidery data, to horizontally move the embroidery frame 21 while actuating the stitching needle 23 vertically, thereby sewing the operator's desired embroidery on the work fabric 22.

As shown in FIG. 2, the control portion 30 is constructed from a microcomputer. The control portion 30 includes: a CPU 2, a ROM 3, a RAM 4, a flash memory device 5 for retrieving embroidery data from and recording embroidery data into the flash memory 10, a liquid crystal display controller (LCDC) 8, and an input/output interface 6, which are connected with each other via a bus line. The interface 6 is for receiving input data from an input portion 11. The LCDC 8 is connected with an image storage device (VRAM) 9 and the liquid crystal display (LCD) 7.

The flash memory device 5 includes: the flash memory insertion slot 24 for receiving a flash memory 10; and a date retrieving/recording unit for retrieving embroidery data from and recording embroidery data into the flash memory 10 inserted in the insertion slot 24.

The flash memory 10 previously stores therein a plurality of sets of embroidery data indicative of a plurality of embroidery patterns which can be sewn by the home embroidery machine 20. Each set of embroidery data includes coordinate data indicative of needle locations in the predetermined X-Y coordinate system for sewing the corresponding embroidery. With this structure, when the flash memory 10 is inserted by the operator into the flash memory insertion slot 24, the stored embroidery data is read out by the flash memory device 5.

The ROM 3 previously stores therein a plurality of sets of embroidery data indicative of a plurality of other embroidery patterns which can also be sewn by the home embroidery machine 20. Each set of embroidery data includes coordinate data indicative of needle locations in the predetermined X-Y coordinate system for sewing the corresponding embroidery. As will be described later, the embroidery data will be used not only for sewing embroidery patterns on the work fabric 22 but also for displaying embroidery patterns 104 and rectangle frames 112, indicative of outward forms of the embroidery patterns 104, on layout screens (FIGS. 8 and 9) on the touch panel 25.

The ROM 3 also stores therein several sets of processing program data such as an embroidery producing program and an embroidery pattern displaying state changing process program as will be described later. The ROM 3 further stores therein several sets of binary bit map data indicative of shapes of a plurality of embroidery patterns. The binary bit map data will be used for displaying images of embroidery patterns on a pattern selection screen of FIG. 6 and on a selected pattern screen of FIG. 7 as will be described later. The ROM 3 also stores therein other various sets of bit map data necessary for producing the screens of FIGS. 5–11 which will be described later.

The LCDC 8 is for controlling the LCD 7 to display monochromatic bit map graphic screens of FIGS. 5–11 based on data which has been retrieved from the flash memory 10 or the ROM 3 and which is temporarily stored in the VRAM 9. The touch panel 25 is constructed from the thus produced screens. The operator can manipulate the touch panel 25 and control the home embroidery machine 20.

Figure 8:
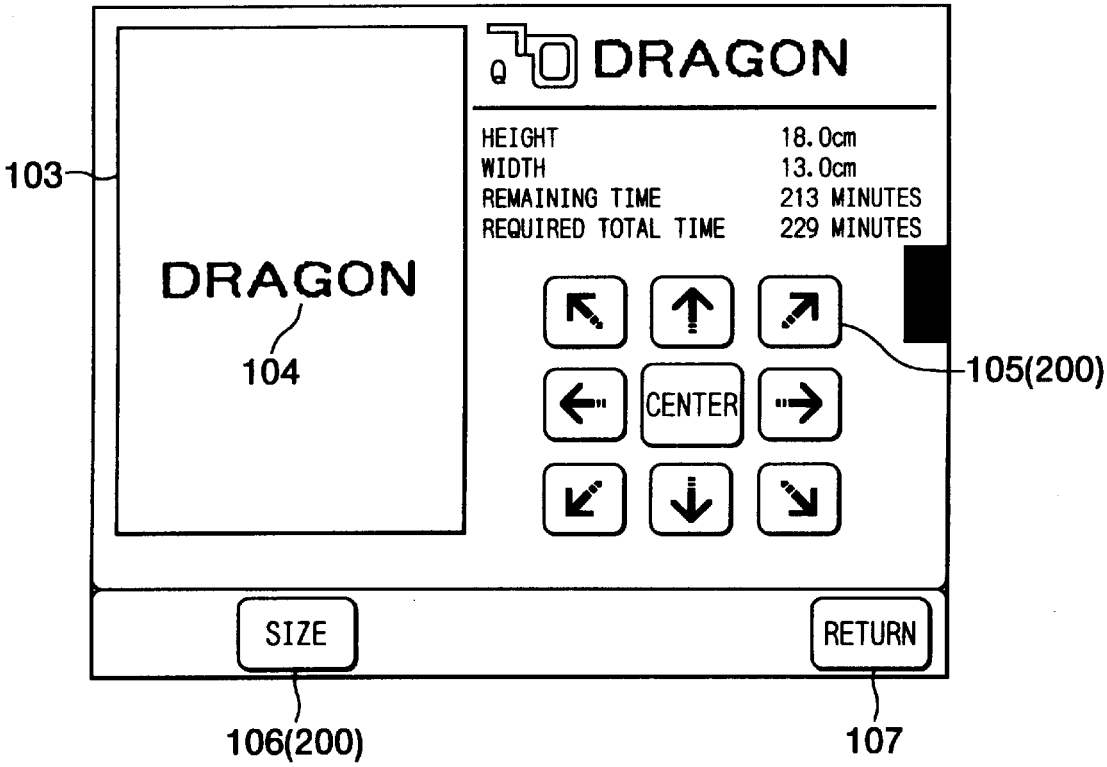
FIG. 8 shows one example of a layout screen displayed on the touch panel in an image display mode.
Figure 9:
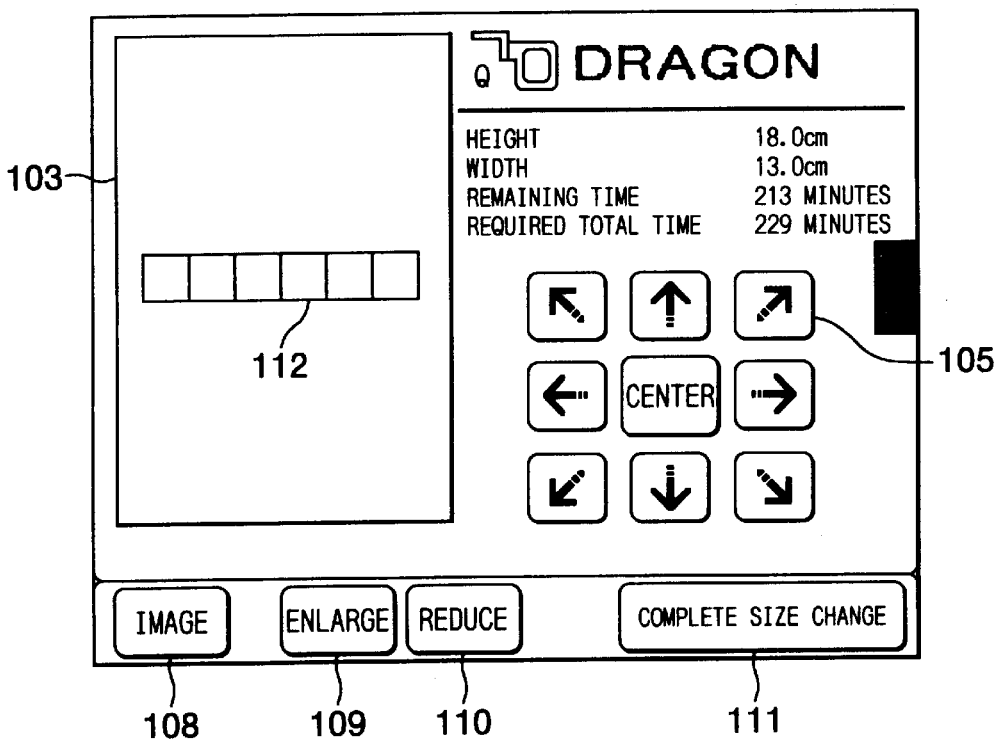
FIG. 9 shows one example of the layout screen in a rectangular frame display mode.

It is noted that the LCDC 8 can control the touch panel 25 to show a layout screen both in an image display mode as shown in FIG. 8 for displaying realistic images of embroidery patterns and in a rectangular frame display mode as shown in FIG. 9 for displaying rectangular frames indicative of outward forms of the embroidery patterns. In other words, the rectangular-frame displaying mode displays representative images of the embroidery patterns.

The RAM 4 is for storing embroidery data produced during an embroidery processing process as will be described later.

The input portion 11 includes the sewing start key 26 and the touch panels 25 produced on the LCD 7. The sewing start key 26 is or instructing start of a sewing operation. The touch panel 25 is for instructing selection of the operator's desired embroidery patterns and for instructing change of the embroidery patterns in size. The instructions thus inputted at the input portion 11 are transferred via the interface 6 to the CPU 2 and the RAM 4.

The CPU 2 is for controlling the entire home embroidery machine 20. For example, the CPU 2 executes the embroidery producing program for producing the operator's desired embroidery data and then sewing the operator's desired embroidery accordingly. The CPU 2 also executes the embroidery pattern displaying state changing process program, as a subroutine for the embroidery producing program, to switch the display mode of the layout screen from the image display mode to the rectangular frame display mode before changing the size of the selected embroidery patterns.

With the above-described structure, the home embroidery machine 20 performs the embroidery producing operation. During the embroidery producing operation, the operator edits, with using the touch panel 25, embroidery data retrieved from the flash memory 10 and/or the ROM 3, to thereby produce embroidery data indicative of the operator's desired embroidery. In more concrete terms, the operator instructs the control portion 30 to select his/her desired embroidery pattern and to change the selected embroidery pattern in size. The control portion 30 performs an embroidery pattern displaying state changing operation to change the display state before changing the sizes of the embroidery patterns. The control portion 30 then calculates embroidery data indicative of the operator's selected and size-changed embroidery pattern. The control portion 30 controls the sewing portion 40 to sew the operator's selected and size-changed embroidery pattern on the work fabric 22 based on the produced embroidery data.

The home embroidery machine 20 performs the embroidery producing operation as described below.

Figure 3:
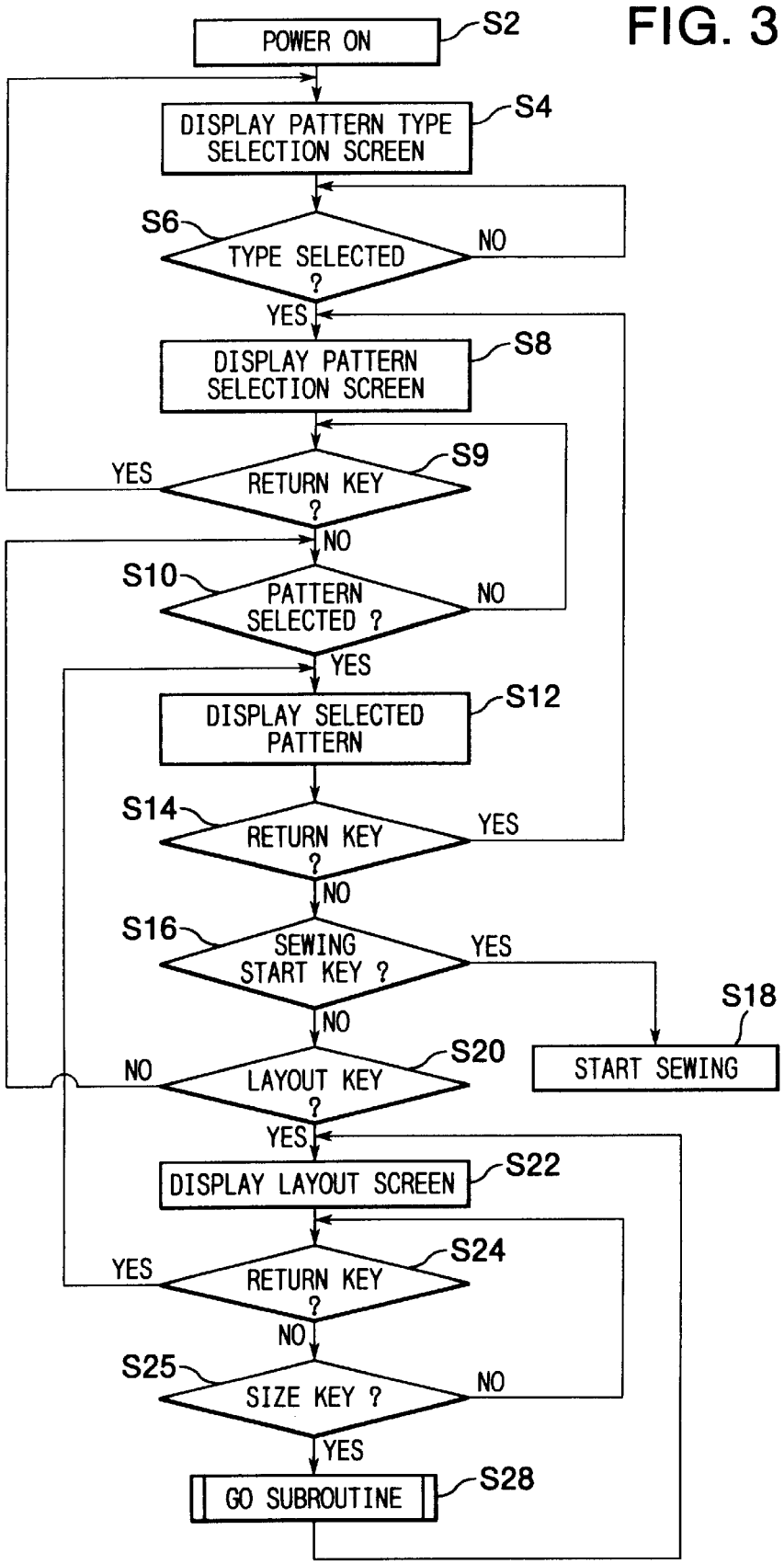
FIG. 3 is a flowchart of an embroidery sewing operation performed by the sewing machine of FIG. 1.
Figure 5:
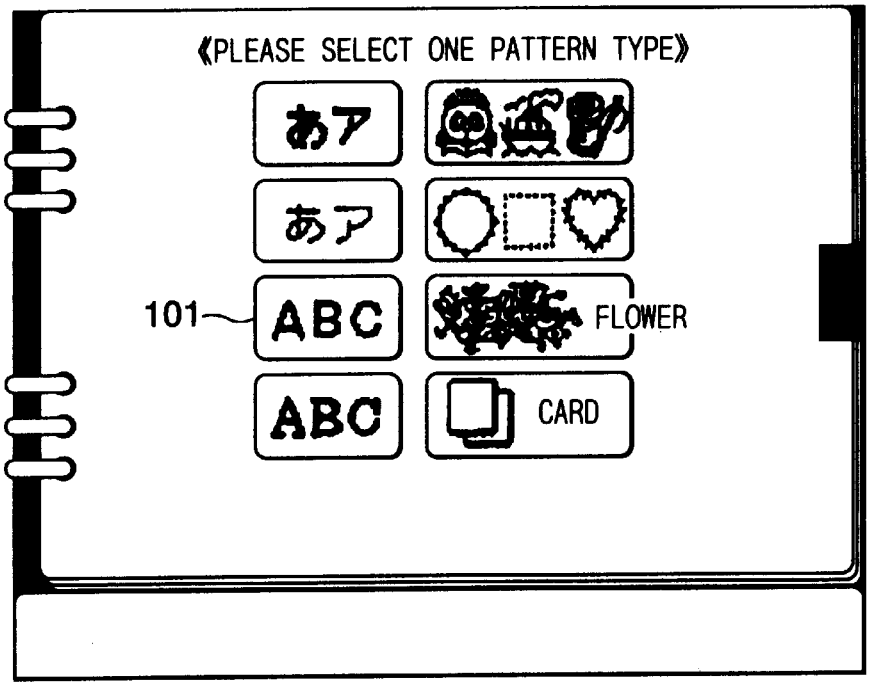
FIG. 5 shows one example of a pattern type selection screen displayed on a touch panel provided to the sewing machine of FIG. 1.

As shown in FIG. 3, when the operator first turns on the power to the embroidery machine 20 in S2, the CPU 2 controls the LCDC 8 to show a pattern type selection screen as shown in FIG. 5 on the touch panel 25 in S4.

Then, in S6, the operator selects one pattern type from among those displayed on the pattern type selection screen. It is now assumed that the operator selects a pattern type 101 shown in FIG. 5. When the pattern type 101 is thus selected (Yes in S6), the CPU 2 further controls the LCDC 8 to show a pattern selection screen shown in FIG. 6 on the touch panel 25 in S8. It is noted that the CPU 2 produces images of a plurality of embroidery patterns displayed on the pattern selection screen based on the bit map data retrieved from the ROM 3.

Figure 6:
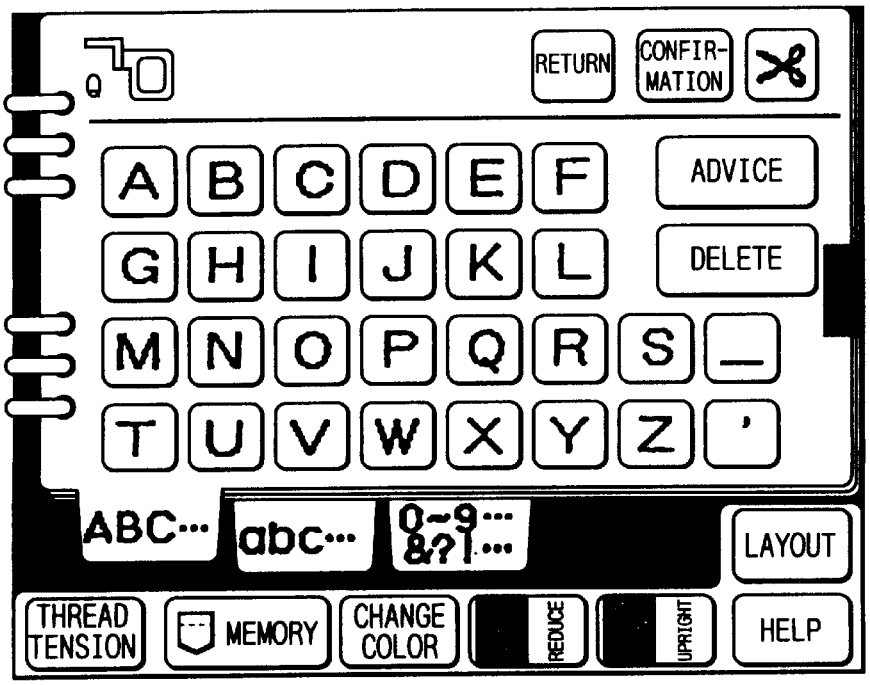
FIG. 6 shows one example of a pattern selection screen displayed on the touch panel of the sewing machine of FIG. 1.

When the operator depresses a return key on the pattern selection screen of FIG. 6 (Yes in S9), the screen goes back to the pattern type selection screen of FIG. 5, and the above-described steps S4 through S9 are repeated. Thus, another pattern type can be easily selected.

Figure 7:
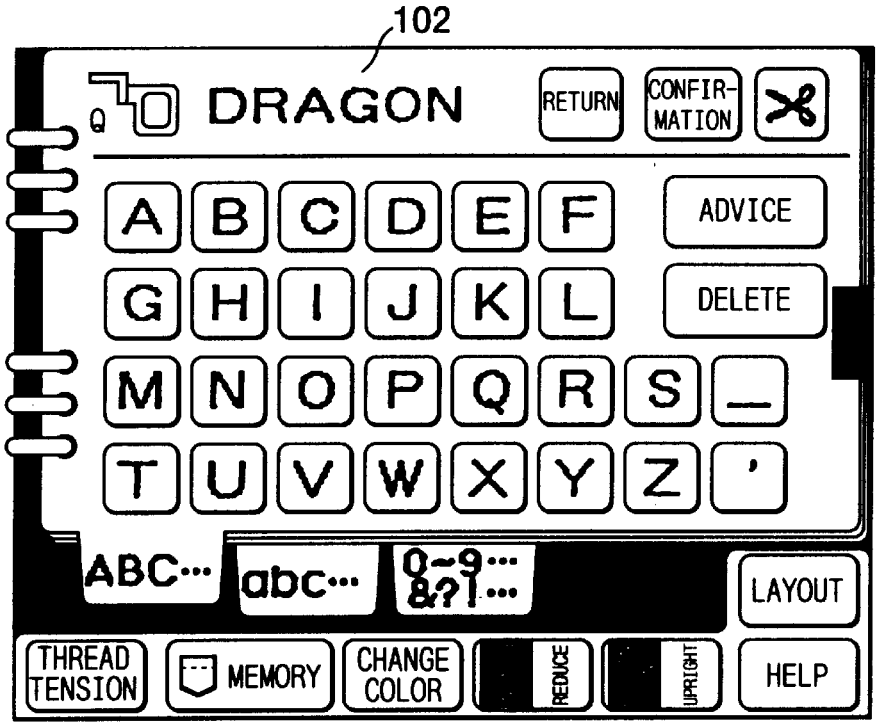
FIG. 7 shows one example of a screen showing a selected pattern displayed on the touch panel.

While the pattern selection screen of FIG. 6 is displayed, the operator can select one embroidery pattern from among the displayed patterns in S10. When the operator selects one embroidery pattern 102 (Yes in S10), the CPU 2 controls in S12 the LCDC 8 to show the selected pattern 102 on the LCD 7 as shown in FIG. 7. It s noted that the CPU 2 produces the image of the selected pattern screen of FIG. 7 also based on the bit map data retrieved from the ROM 3.

When the operator desires to select embroidery patterns 102 of a plurality of characters "D", "R", "A", "G", "O", and "N", for example, the operator successively selects the characters "D", "R", "A", "G", "O", and "N" without depressing any other keys such as a return key, the sewing start key 26, or the layout key. As a result, the routine of S10, S12, S14, S16, and S20 is repeatedly performed, so that the embroidery patterns 102 of "D", "R", "A", "G", "O", and "N" are selected. The selected embroidery pattern displayed in S12 as shown in FIG. 7.

When the operator depresses the return key on the selected pattern screen (Yes in S14), on the other hand, the screen goes back to the pattern selection screen of FIG. 6. Then, the above-described steps S8 through S14 are repeated, thereby allowing the operator to change select of his/her desired patterns.

the operator can depress a layout key on the touch panel 25 (Yes in S20) while the selected pattern screen of FIG. 7 is displayed. When the operator depresses the layout key (Yes in S20), the CPU 2 controls the LCDC 8 to show a layout screen shown in FIG. 8 on the touch panel 25 in S22.

As shown in FIG. 8, the layout screen displays an image of the predetermined sewable region 103, within which the home embroidery machine 20 can sew embroideries with the stitching needle 23. The layout screen of FIG. 8 is initially in the image display mode for displaying realistic images 104 of the selected embroidery patterns 102 in the sewable region 103 as shown in FIG. 8.

It is noted that the selected patterns 104 are initially arranged with a uniform interval D of zero (0) and are located with their central point being positioned at a central position of the sewable region 103. In other words, the coordinate (XM, YM) of the center point of the patterns 104, defined in the XY coordinate system, is initially set equal to the coordinate of the central position of the sewable region 103.

It is further noted that the CPU 2 produces the realistic images 104 of the embroidery patterns 102 and rectangular frames 112 (which will be described below), indicative of the outward forms of the selected embroidery patterns 102, based on the set of embroidery data for the selected patterns 102 which is retrieved from the ROM 3 or the flash memory 10.

The layout screen also displays various layout changing keys 200. The layout changing keys 200 are for editing layout of the selected patterns 104. The layout changing keys 200 include: eight arrow keys 105; and a size key 106. The arrow keys 105 are for moving the selected embroidery patterns 104 in the arrow-indicating directions. In this example, when an arrow key is depressed once, the patterns 104 are moved by 0.1 mm in the arrow-indicating direction. The size key 106 is for enlarging or reducing the size of the selected embroidery patterns.

It is noted that the layout screen also displays a return key 107. The return key 107 is for returning the layout screen back to the screen of the selected pattern screen of FIG. 7.

It is noted that FIG. 8 merely shows an example of the keys on the layout screen. The layout screen may further include a rotation key for rotating the selected embroidery patterns about its center by a desired amount of angle, an arrangement change key for changing an arrangement how the selected embroidery patterns are arranged, and an interval changing key for changing an interval between the selected embroidery patterns.

After thus displaying the layout screen of the image display mode, the CPU 2 judges in S25 whether or not the size key 106 is depressed. If so (YES in S25), an embroidery pattern displaying state changing process is achieved in S28. That is, in S28, the CPU 2 executes the sub-routine shown in FIG. 4 to perform the embroidery pattern displaying state changing process.

Figure 4:
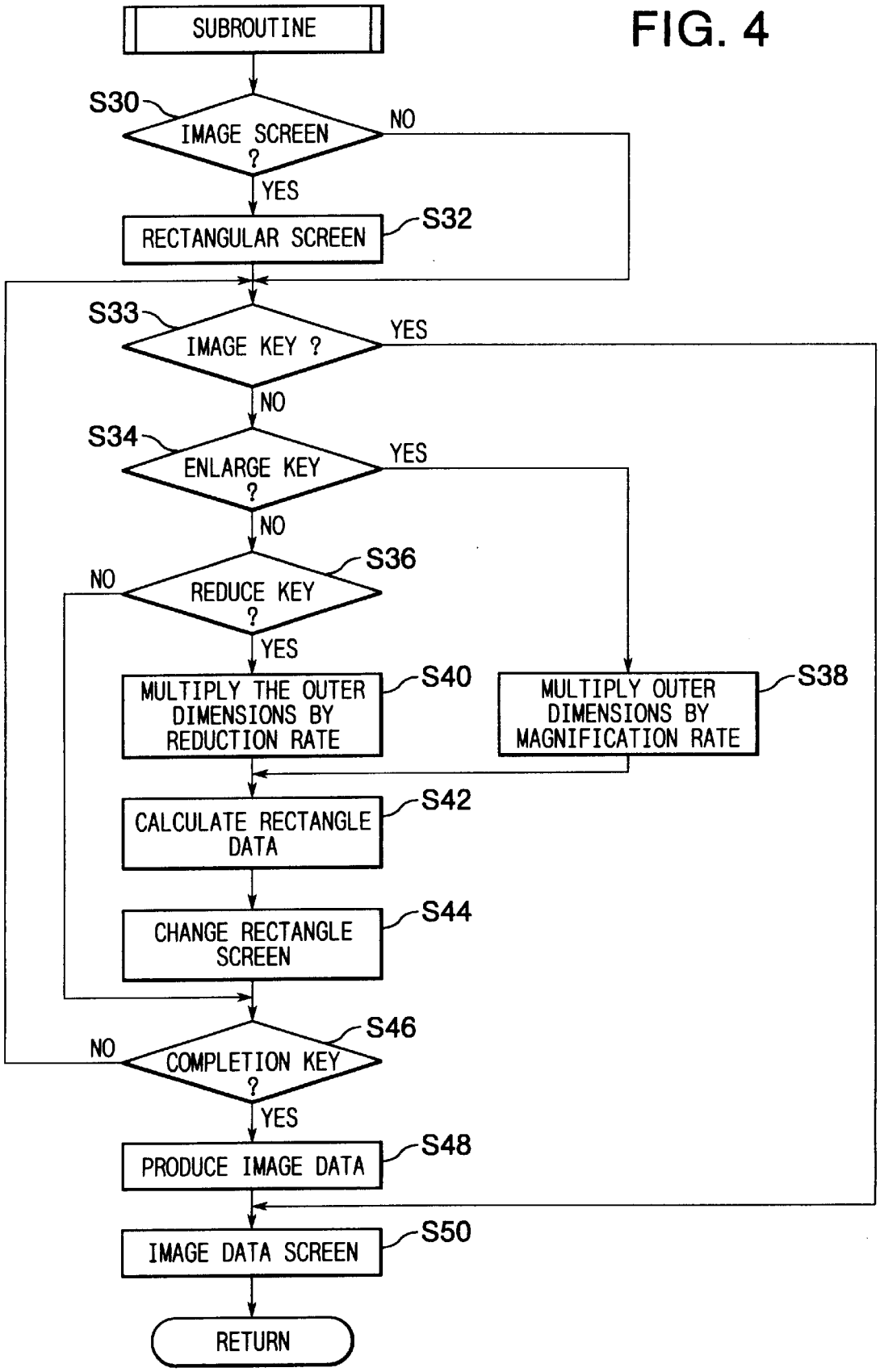
FIG. 4 is a flowchart of an embroidery pattern display state switching process performed in the embroidery sewing operation of FIG. 3.

During the embroidery displaying pattern state changing process, as shown in FIG. 4, the CPU 2 first judges in S30 whether or not the embroidery patterns 104 are presently being displayed in the image display mode. If so (YES in S30), the CPU 2 switches in S32 the image display mode to a rectangular frame display mode as shown in FIG. 9. In the rectangular frame display mode, the CPU 2 controls the LCDC 8 to display a rectangular frame 112 for each of the selected embroidery patterns 104. Each rectangular frame 112 approximately represents an outward form of the corresponding embroidery pattern. Each rectangular frame 112 therefore has a size corresponding to a size of the corresponding embroidery pattern. In other words, each rectangular frame 112 is a rectangular frame of a minimum size that can surround the corresponding embroidery pattern. The rectangular frames 112 can thus represent the embroidery patterns 104. This automatic switching of the screen simplifies the user's manipulation.

The process of S32 for the automatic display mode switching operation will be described below in greater detail while referring to FIGS. 12 through 14.

In this example, six embroidery patterns "D", "R", "A", "G", "O", and "N" have been selected in S10 on the pattern selection screen of FIG. 6. As described already, the thus selected embroidery patterns are aligned with a uniform interval D (D=0). The central position (XM, YM) of the entire patterns 104 is located at a central position of the sewable region 103. It is noted that the interval D and the central position (XM, YM) of the embroidery patterns 104 may have other values when an interval changing key (not shown) and/or the arrow keys 105 (produced on the layout screen) have been already manipulated.

Figure 12:
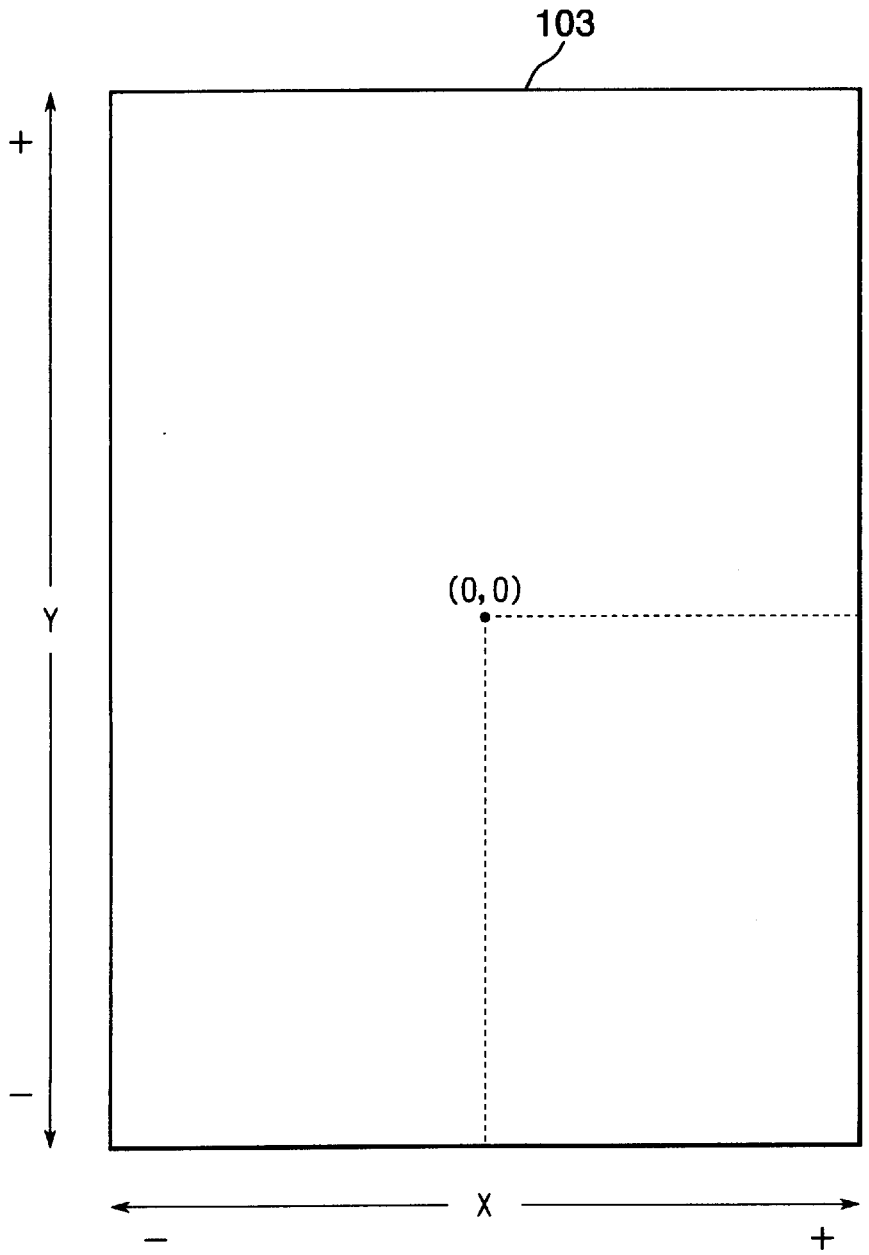
FIG. 12 illustrates how the sewable region 103 is defined in the XY coordinate system.
Figure 13:
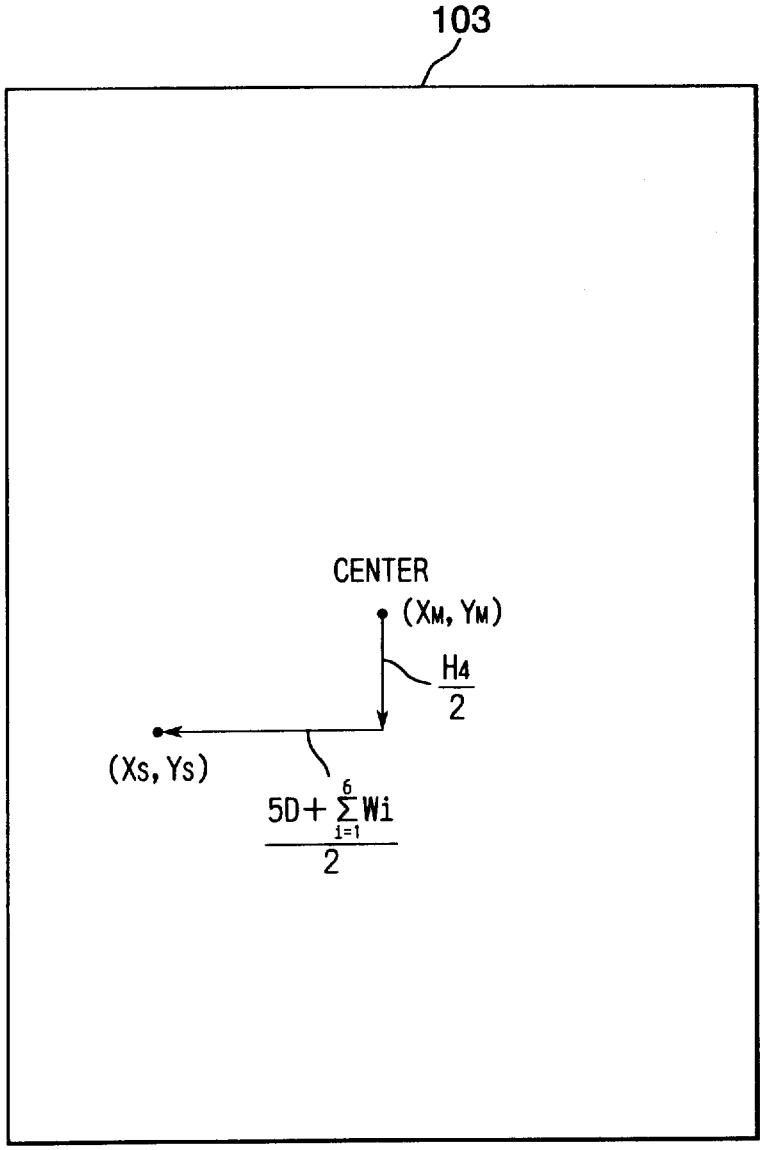
FIG. 13 illustrates how the selected embroidery patterns are located in the sewable region 103.

As shown in FIG. 12, the center position of the sewable region 103 has a coordinate (0, 0) defined in the X-Y coordinate system. The center position (0, 0) is determined as an origin. Rectangular frames 112 indicative of the embroidery patterns "D", "R", "A", "G", "O", and "N" have heights H1, H2, H3, H4, H5, and H6, and widths W1, W2, W3, W4, W5, and W6 as shown in FIG. 14. Data of these heights and widths are included in the embroidery data of the embroidery patterns retrieved from the ROM 3 or the flash memory 10. The center point (XM, YM) of an entire image constructed from all the embroidery patterns "D", "R", "A", "G", "O", and "N" is defined as shown in FIG. 13. It is now assumed that the highest height H among the heights H1–H6 is H4 as shown in FIG. 14.

In S32, the CPU 2 first determines the highest height H (H4 in this example) among the heights H1–H6. Then, the CPU 2 calculates a coordinate of a start point (XS, YS) for the six rectangles 112, that is, a lower-left corner of the six rectangles 112 shown in FIG. 13. The CPU 2 calculates the coordinate of the start point (XS, YS) by the following formulas:

$$XS=XM-(W1+D+W2+D+W3+D+W4+D+W5+D+W6)/2$$

$$YS=YM-H4/2$$

Figure 14:
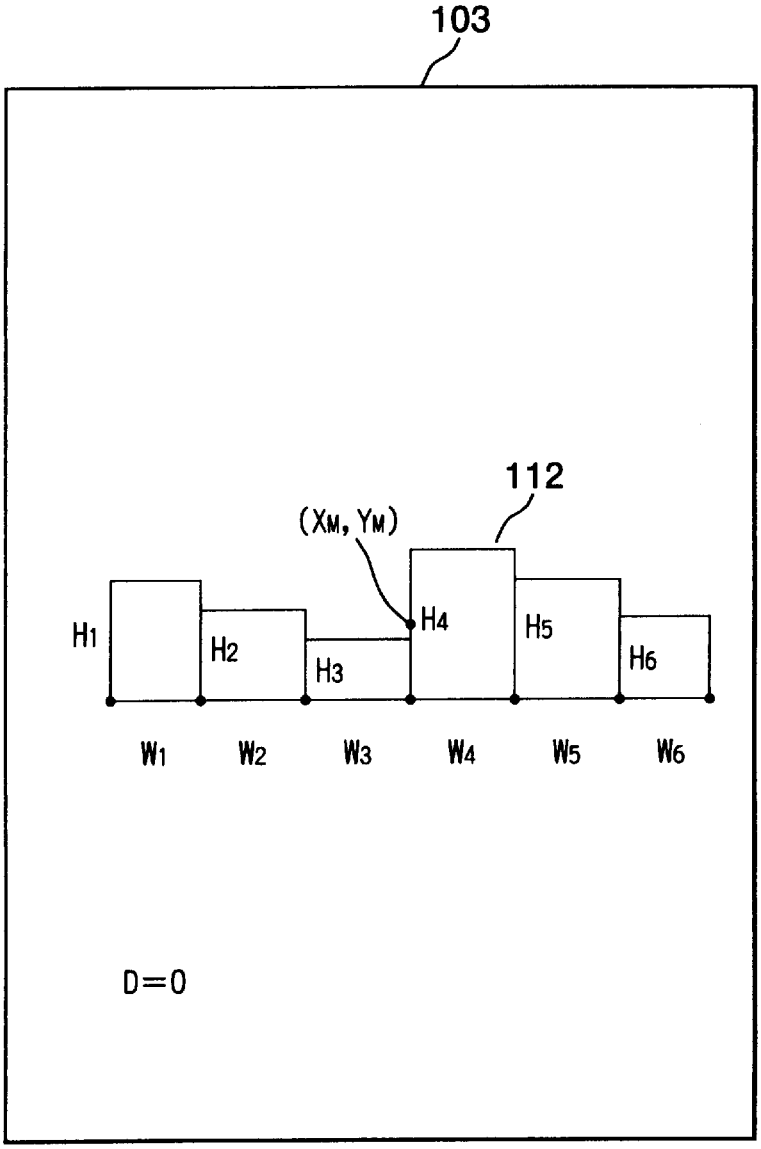
FIG. 14 illustrates, in greater detail, how the rectangular frames representative of the selected embroidery patterns are arranged in the sewable region 103.

Then, rectangle data for the six rectangles 112 is calculated based on the start point coordinate (XS, YS), the height data H1–H6, and the width data W1–W6 of the six embroidery patterns "D", "R", "A", "G", "O", and "N." Based on the calculated rectangle data, the CPU 2 controls the LCDC 8 to display on the LCD 7 the six rectangles 112 as shown in FIG. 14.

It is noted that amount of the thus produced rectangle data, indicative of the respective rectangle frames 112, is much less than that of image data indicative of the corresponding embroidery pattern images "D", "R", "A", "G", "O", and "N." Accordingly, it requires less amount of time length to calculate the rectangle data than to calculate the image data. Therefore, the embroidery patterns with their sizes, positions, and their rotational angles being changed, can be displayed speedily in the form of the rectangular frames. Also, because all the embroidery patterns are represented by the same type of rectangles, the user can easily grasp how the embroidery patterns are arranged.

Thus, the image display mode of FIG. 8 is switched in S32 into the rectangular frame display mode of FIG. 9. As shown in FIG. 9, the layout screen in the rectangular frame display mode has: an image key 108 for returning the rectangular frame display mode back to the image display mode; an enlarge key 109 for enlarging the size of the displayed rectangular frames with the operator's desired magnification rate; a reduction key 110 for reducing the size of the displayed rectangular frames with the operator's desired reduction rate; and complete size change key 111 for instructing completion of size change.

Then, in S33, the CPU 2 judges whether or not the image key 108 is depressed. If so (YES in S33), the layout screen is switched from the rectangle frame display mode back to the image display mode shown in FIG. 8. Then, the program returns to the main routine in FIG. 3. Accordingly, the operator can confirm whether or not the embroidery patterns are arranged as desired even after he/she manipulates the size key 106 in S25.

When the image key 108 is not depressed (NO in S33), on the other hand, the CPU 2 judges in S34 whether or not the enlarge key 109 is depressed to designate the operator's desired magnification rate. If so (YES in S34), the program proceeds to S38 where the CPU 2 multiplies the heights H1, H2, H3, H4, H5, and H6, the widths W1, W2, W3, W4, W5, and W6, and the interval D by the operator's designated magnification rate. Then, in S42, the CPU 2 calculates rectangle data for the enlarged rectangular frames 112. Based on the rectangle data, the CPU 2 controls the LCDC 8 to display the enlarged rectangular frames 112 in S44.

On the other hand, when the enlarge key 109 is not depressed (NO in S34), the CPU 2 further judges in S36 whether or not the reduce key 10 is depressed. If so (YES in S36), the program proceeds to S40 where the CPU 2 multiplies the heights H1, H2, H3, H4, H5, and H6, the widths W1, W2, W3, W4, W5, and W6, and the interval D by the operator's designated reduction rate. Then, in S42, the CPU 2 calculates rectangle data for the reduced rectangular frames. Based on the calculated data, the CPU 2 controls the LCDC 8 to display the reduced rectangular frames in S44.

Figure 10:
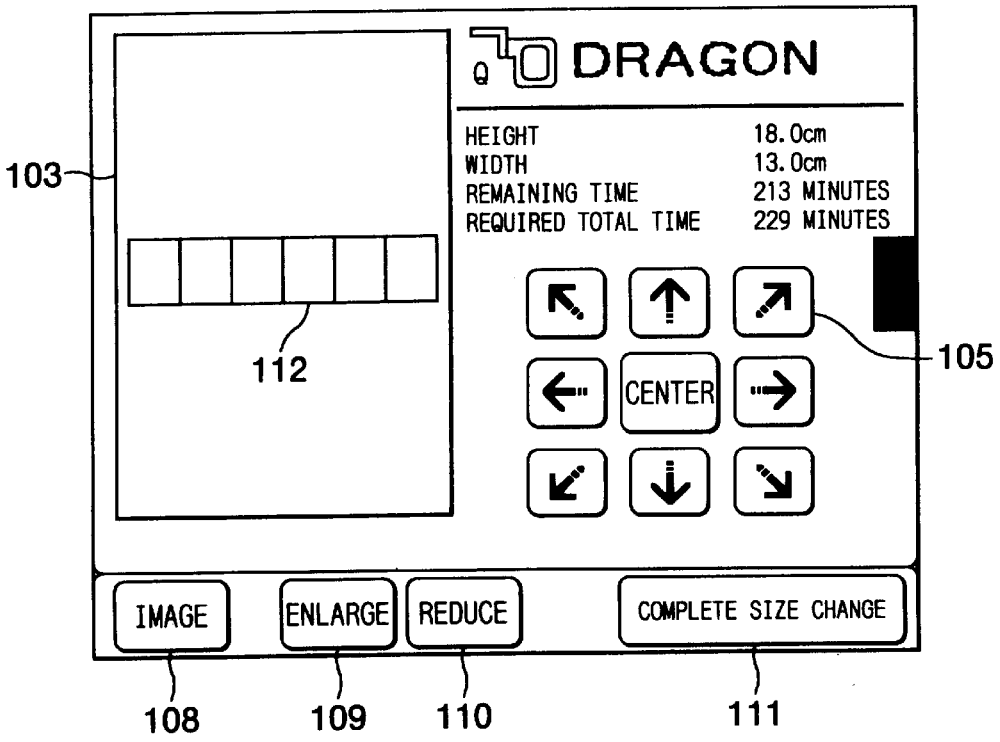
FIG. 10 shows one example of the layout screen in the rectangular frame display mode, in which the selected embroidery patterns have been enlarged.

It is now assumed that the enlarge key 108 is depressed in S34. In this case, the layout screen in the rectangular frame display mode displays the enlarged rectangles 112 as shown in FIG. 10.

Figure 11:
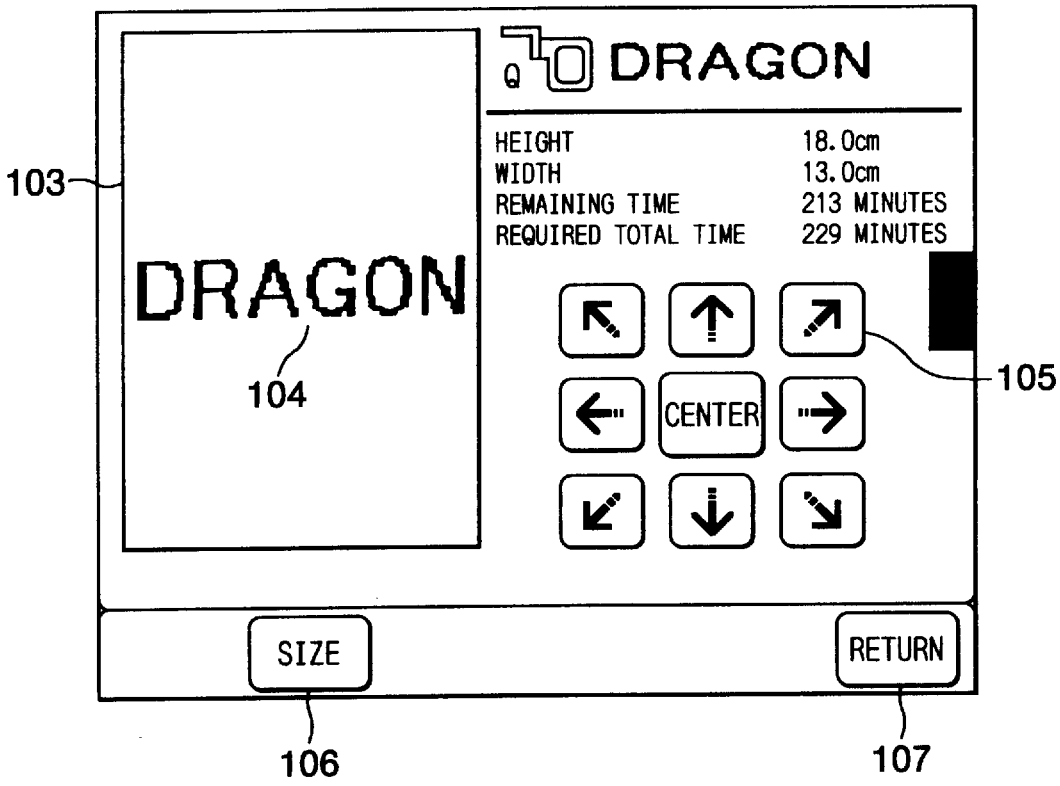
FIG. 11 shows one example of the layout screen in the image display mode, in which the selected embroidery patterns have been enlarged.

The processes S33 through S44 are repeated until the completion key 111 is depressed (NO in S46). When the size change completion key 111 is depressed (YES in S46), the size changing operation is completed, and the CPU 2 calculates image data of the enlarged embroidery patterns "D", "R", "A", "G", "O", and "N" for the image display mode in S48. Then, the CPU 2 controls the LCDC 8 in S50 to display the layout screen of the image display mode as shown in FIG. 11. Then, the program returns to the main routine in FIG. 3.

Thus, the embroidery patterns are enlarged or reduced while they are displayed as the rectangular frames. Accordingly, the rectangular frames of the enlarged/reduced embroidery patterns can be displayed speedily.

Figure 15:
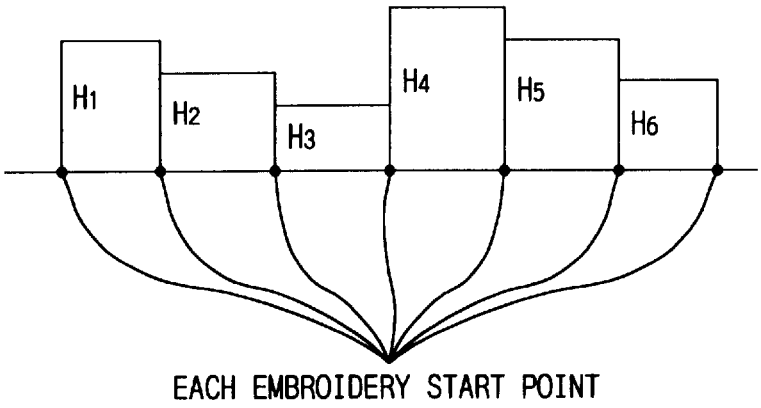
FIG. 15 illustrates how embroidery data is produced for the selected embroidery patterns.

It is noted that as shown in FIG. 15, embroidery data for each original embroidery pattern is constructed from a plurality of needle location data defined relative to a lower-left corner point of a corresponding rectangular frame. Accordingly, when calculating embroidery data for the respective enlarged/reduced embroidery patterns in S18, the lower-left corners (needle location start points) of the respective enlarged/reduced embroidery patterns will be calculated through serially accumulating the products, of the respective rectangle sizes and the magnification/reduction rate, onto the start point (XS, YS) of the enlarged/reduced embroidery patterns which is obtained in S42.

During the main routine of FIG. 3, the processes S24 through S28 are repeatedly performed until the return key 107 is depressed on the layout screen. When the return key 107 is depressed (YES in S24), the program returns to S12 to display the embroidery pattern screen of FIG. 7. When the sewing start key 26 is depressed (YES in S16), the CPU 2 calculates embroidery data based on embroidery data of the selected embroidery patterns retrieved from the ROM 3 or the flash memory 10, the position of the embroidery patterns, the changed size of the embroidery patterns, and the like. The CPU 2 records the produced embroidery data in the RAM 4. The embroidery data may also be recorded in the flash memory 10 by the flash memory device 5 when instructed by the operator's manipulation of a record key (not shown). Then, the sewing portion 40 starts sewing the embroidery patterns in S18 under control by the control device 30.

As described above, according to the present embodiment, a realistic image of the sewing pattern is displayed based on sewing pattern data indicative of a shape of the sewing pattern. The state of the sewing pattern can be changed in S34–S40. When desiring to change the sewing pattern state while the image of the sewing pattern is displayed in the image display mode, the display state is changed from the image display mode into the rectangular-frame display mode in S30 and S32 so that a rectangular frame representative of the sewing pattern is displayed. When the pattern state change is completed (yes in S46), the image of the changed sewing pattern is displayed in S48 and S50.

While the invention has been described in detail with reference to the specific embodiment thereof, it would be apparent to those skilled in the art that various changes and modifications may be made therein without departing from the spirit of the invention.

For example, the above-described display state changing operation is performed when the size of the embroidery patterns is to be changed. However, the display state changing operation can be performed also when other various pattern states of the embroidery patterns are changed. For example, the display state may be switched into the rectangular frame display mode when the embroidery patterns are to be rotated, when an interval between the embroidery patterns is to be changed, or when an arrangement state of the embroidery patterns is to be changed.

A modification of the display state changing operation will be described below. This display state changing operation is performed when the embroidery pattern is to be rotated.

Figure 16:
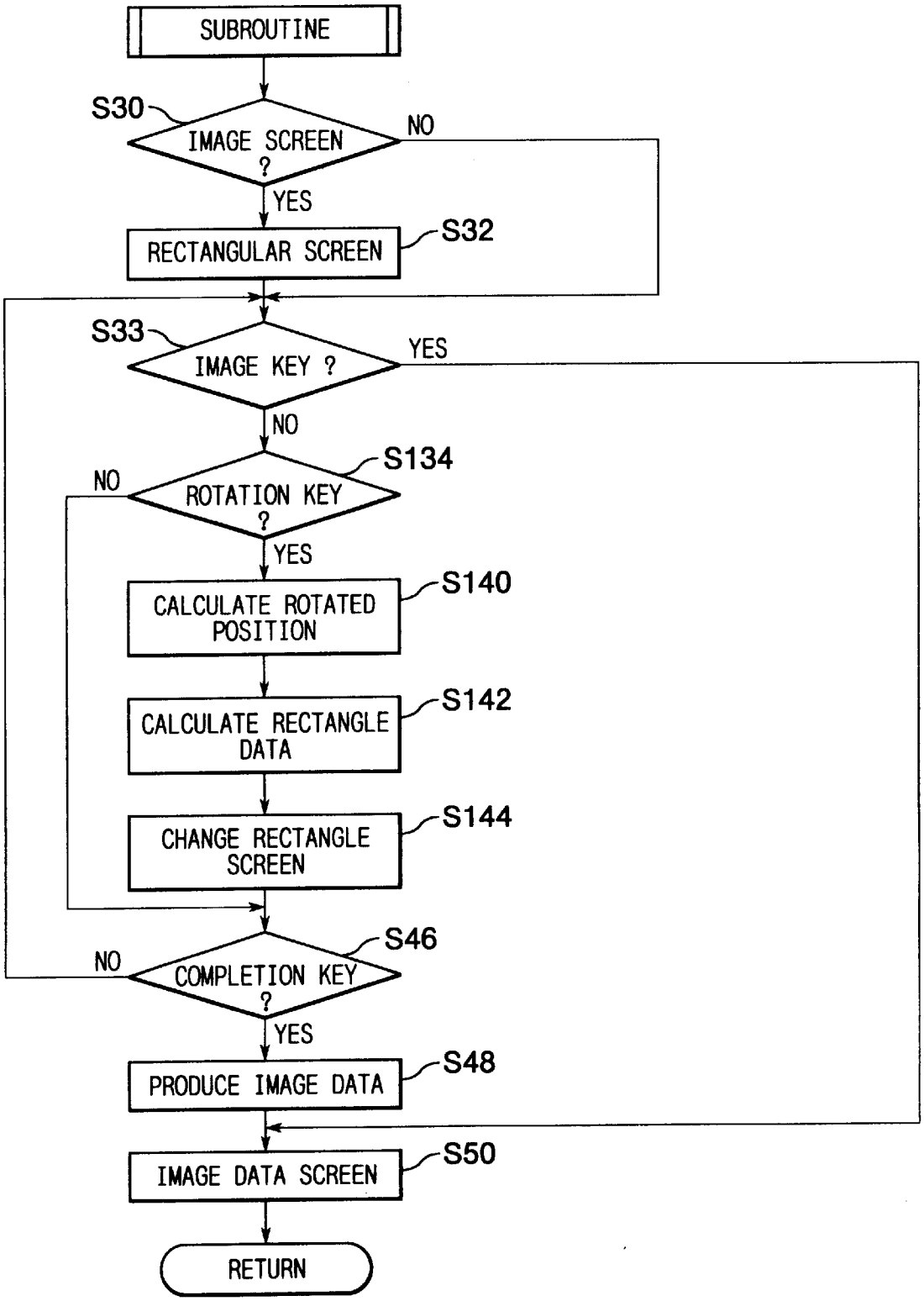
FIG. 16 is a flowchart of a modification of the embroidery pattern display state switching process.
Figure 17:
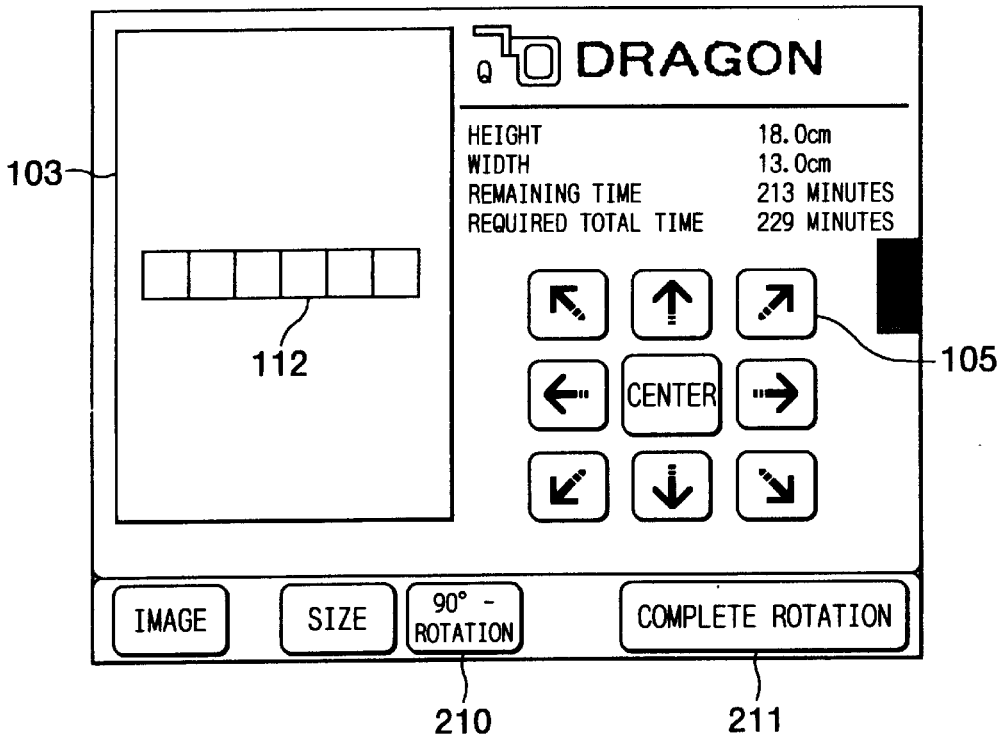
FIG. 17 shows one example of the layout screen in a rectangular frame display mode according to the modification.
Figure 18:
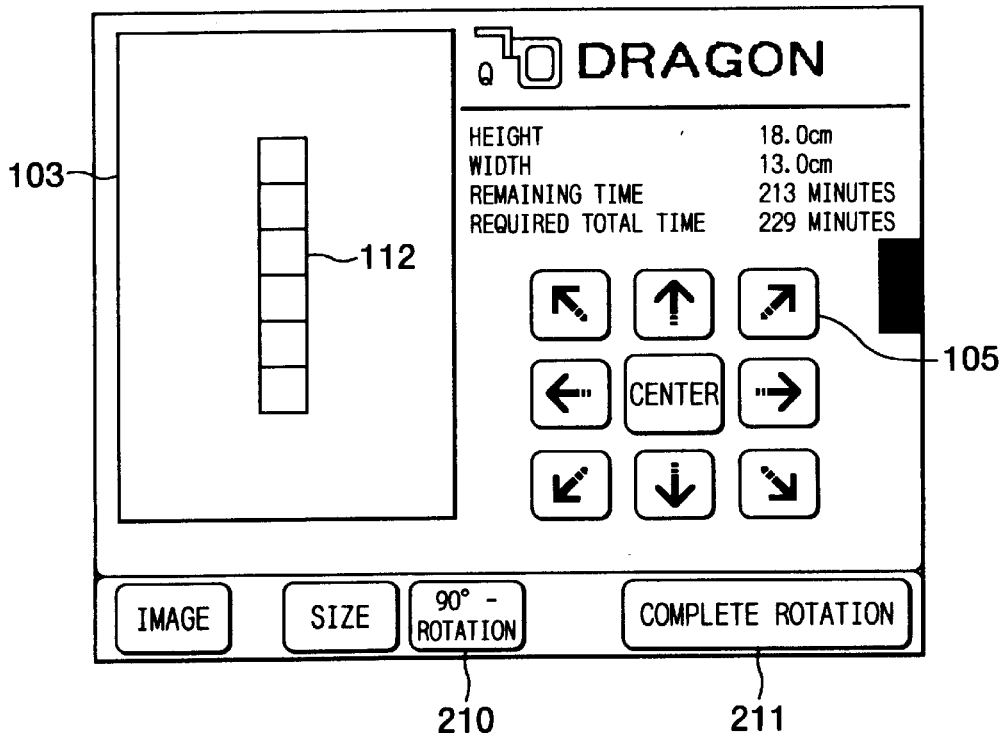
FIG. 18 shows one example of the layout screen in the rectangular frame display mode, in which the selected embroidery patterns have been rotated according to the modification.

In order to perform the display state changing operation of this modification, the step S25 in the embroidery producing process shown in FIG. 3 is modified so as to detect whether or not the operator depresses a rotation key (not shown) provided on the layout screen of FIG. 8. When the rotation key is depressed, the display state changing routine as shown in FIG. 16 is executed. During the display state changing routine of FIG. 16, the CPU 2 executes the processes of steps S30 through S33 in the same manner as in the above-described embodiment. In S32, the touch panel 25 displays the screen of the rectangular frame mode as shown in FIG. 17. When the operator manipulates a 90-degree rotation key 210 displayed on the screen of FIG. 17 in S134, the CPU 2 calculates a rotated position of the rectangular frames 112 in S140, and then calculates rectangle data for the rotated embroidery patterns 104 in S142. Then, the rotated rectangle frames 112 are displayed as shown in FIG. 18. Then, the CPU 2 performs the same operations as those of S46 to S50 in FIG. 4.

In the above-described embodiment, rectangular frames, indicative of the embroidery patterns, are displayed while the embroidery patterns are enlarged or reduced. However, frames of any shapes, such as circle and triangle, can be used to represent the embroidery patterns instead of the rectangular frames.

The display mode switching operations in S30 and S32 can be performed right after the affirmative judgement in S34 (YES in S34) or the affirmative judgement in S36 (Yes in S36) rather than after the sub-routine of FIG. 4 has been started.

In the above-described embodiment, the layout screen is initially in the image display mode. However, the layout screen may be initially in the rectangular frame display mode.

In the above-described embodiment, the ROM 3 stores therein bit map data for displaying embroidery patterns on both of the pattern selection screen of FIG. 6 and the selected pattern screen of FIG. 7. The embroidery data of the plurality of embroidery patterns are stored in the ROM 3 and the flash memory 10. However, these data can be stored in other external storage media such as a floppy disk and a ROM card. These data may be retrieved from the external storage media and are displayed on the LCD 7 as required according to commands instructed from the CPU 2 in the same manner as described above.

Similarly, though the program data is stored in the ROM 3 in the above-described embodiment, the program data may be stored in an external storage medium.

The above-described embodiment is directed to a sewing machine provided with the sewing portion 40. However, the present invention can be applied to a sewing data processing device not provided with a sewing mechanism.

In the above-described embodiment, the CPU 2 calculates data for displaying the embroidery pattern images 104 and the rectangle frames 112 of the selected patterns on the layout screen of FIGS. 8–11 based on the embroidery data, of the selected patterns, retrieved from the ROM 3 or the flash memory 10. That is, the CPU 2 calculates display data of the selected patterns and of the selected pattern rectangle frames based on sewing data indicative of needle locations for sewing the selected patterns. However, display data of the embroidery patterns 104 and of the rectangle frames 112 may be previously stored as well as embroidery data in the ROM 3 and/or the external storage media such as the flash memory 10. The display data will directly control the LCD 7 to display the selected patterns 104 and the rectangle frames 112 as shown in FIGS. 8 and 9. The embroidery data, indicative of needle locations of the selected patterns, will be used only for sewing the selected patterns. Alternatively, the ROM 3 and/or the external storage media may previously store only display data. The CPU 2 may produce embroidery data based on the display data. Or otherwise, the ROM 3 and/or the external storage media may previously store pattern data indicative of a plurality of embroidery patterns. The CPU 2 may produce both embroidery data and display data based on the pattern data.

In the above-described embodiment, the ROM 3 and/or the external storage media store therein data of a plurality of embroideries to be sewn on the work fabric 22. However, the ROM 3 and/or the external storage media may store a plurality of sets of sewing data of other various sewing patterns such as button hole sewing patterns and pocket sewing patterns. Each set of sewing data includes data indicative of needle locations of a corresponding sewing pattern. The CPU 2 may perform a process similar to the embroidery producing processes of FIGS. 3 and 4 to sew the pattern such as the button hole sewing patterns and the pocket sewing patterns.

As described above, according to the sewing data processing device of the present invention, a sewing pattern is displayed based on sewing pattern data indicative of a shape of the sewing pattern. The display mode of the sewing pattern is changed from an image display mode into another display mode when the pattern state of the sewing patterns is to be changed. Thus, the display state is changed from the image display mode into another display mode every time the pattern state of the sewing pattern is changed. For example, the display state is changed from the image display mode into another display mode every time the size of the sewing pattern is enlarged or reduced. The display state may be changed from the image display mode into another display mode every time the sewing pattern is rotated. The display state may be changed from the image display mode into another display mode every time the interval between the sewing patterns is changed or the arrangement how the sewing pattern is arranged is changed. Data for the other display mode (the rectangular-frame display mode, for example) has a smaller amount than does data for the image display mode. It is possible to more easily process data for the other display mode than to process data for the image display mode. It is therefore possible to easily display the changed pattern state of the sewing pattern within a short period of time. It takes a shorter period of time to change the pattern state of the sewing pattern while being displayed in the other display mode than to change the pattern state of the sewing pattern while being displayed in the image display mode.

The display mode returns from the other display mode into the image display mode after the pattern state of the sewing pattern is changed. Accordingly, it is unnecessary to produce image data while the pattern state of the sewing pattern is changed. It is therefore possible to decrease the number of times for processing image data and for displaying the processed image data. It is possible to shorten the period of time for changing the display state. The operator can further confirm the pattern state-changed sewing pattern in the image display mode.

During the other display mode, a predetermined shape of the sewing pattern is displayed in correspondence with the size of the sewing pattern. Different sewing patterns can be displayed by the same shape pattern. Accordingly, the operator can easily grasp the size of the sewing pattern and how the sewing pattern is arranged.

In the embodiment, the predetermined shape of the sewing pattern is made from a line indicative of an outward form of the sewing pattern. The amount of data, indicative of the predetermined shape, is smaller than that of data indicative of the image display mode. It is easier to process data of the predetermined shape than to process data for the image display mode. It is therefore possible to easily change the pattern state of the sewing pattern as displayed on the other display mode within a short period of time.

What is claimed is:

1. A sewing data processing device for processing sewing data, comprising:

display means for displaying a sewing pattern both in an image display state and in another state based on sewing pattern data indicative of a shape of the sewing pattern;

pattern state changing means for changing a pattern state of the sewing pattern; and display changing means for changing the display state of the sewing pattern from the image display state into the other display state before the pattern state changing means changes the pattern state of the sewing pattern.

2. A sewing data processing device as claimed in claim 1, further comprising additional display changing means for changing the display state from the other display state back to the image display state after the pattern state changing means has changed the pattern state.

3. A sewing data processing device as claimed in claim 1, wherein the other display state displays a predetermined shape which corresponds to a size of the sewing pattern.

4. A sewing data processing device as claimed in claim 3, wherein the pattern state changing means changes the size of the sewing pattern.

5. A sewing data processing device as claimed in claim 1, wherein the pattern state changing means rotates the sewing pattern.

6. A sewing data processing device as claimed in claim 3, wherein the predetermined shape of the sewing pattern is made from a line indicative of an outward form of the sewing pattern.

7. A sewing data processing device as claimed in claim 1, further comprising sewing data input means for inputting the sewing data.

8. A sewing data processing device as claimed in claim 7, wherein the sewing data input means includes sewing data storing means for storing the sewing data.

9. A sewing data processing device as claimed in claim 7, further comprising calculation means for calculating sewing data of the sewing pattern with its pattern state being changed by the pattern state changing means.

10. A sewing data processing device as claimed in claim 9, further comprising sewing means for sewing the sewing pattern based on the calculated sewing data.

11. A sewing data processing device for processing sewing data, comprising:

display means for displaying a sewing pattern based on sewing pattern data indicative of a shape of the sewing pattern and for displaying a realistic image of the sewing pattern and a representative image of the sewing pattern, the representative image of the sewing pattern having a predetermined shape indicative of an outward form of the sewing pattern;

pattern state changing means for changing a pattern state of the sewing pattern; and display control means for controlling the display means to display the representative image of the sewing pattern while the pattern state changing means changes the pattern state of the sewing pattern.

12. A sewing data processing device as claimed in claim 11, wherein the display control means controls the display means to display the realistic image of the sewing pattern after the pattern state changing means has changed the pattern state.

13. A sewing data processing device as claimed in claim 12, wherein the predetermined shape is made from a line indicative of an outward form of the sewing pattern.

14. A sewing data processing device as claimed in claim 13, wherein the predetermined shape is made from a frame surrounding the sewing pattern.

15. A sewing data processing device as claimed in claim 11, wherein the pattern state changing means changes the size of the sewing pattern.

16. A sewing data processing device as claimed in claim 11, wherein the pattern state changing means rotates the sewing pattern.

* * * * *